US009895014B2

(12) United States Patent
Sindi et al.

(10) Patent No.: US 9,895,014 B2
(45) Date of Patent: Feb. 20, 2018

(54) SOUND-EMITTING CUP

(71) Applicant: UMM AL-QURA UNIVERSITY, Makkah (SA)

(72) Inventors: Taghreed Sindi, Makkah (SA); Saima Malatani, Makkah (SA)

(73) Assignee: Umm Al-Qura University, Makkah (SA)

( * ) Notice: Subject to any disclaimer, the term of this patent is extended or adjusted under 35 U.S.C. 154(b) by 0 days.

(21) Appl. No.: 14/994,816

(22) Filed: Jan. 13, 2016

(65) Prior Publication Data

US 2017/0055740 A1 Mar. 2, 2017

Related U.S. Application Data

(60) Provisional application No. 62/212,750, filed on Sep. 1, 2015.

(51) Int. Cl.

| | |
|---|---|
| ***A47G 19/22*** | (2006.01) |
| ***H04R 1/02*** | (2006.01) |
| ***H04R 29/00*** | (2006.01) |
| ***H04R 3/00*** | (2006.01) |

(52) U.S. Cl.

CPC ..... *A47G 19/2227* (2013.01); *H04R 1/028* (2013.01); *H04R 3/00* (2013.01); *A47G 2019/2244* (2013.01); *H04R 2400/00* (2013.01)

(58) Field of Classification Search

CPC ..... A47G 19/2227; A47G 2019/2244; H04R 3/00; H04R 1/028; H04R 29/001; H04R 2400/00

See application file for complete search history.

(56) References Cited

U.S. PATENT DOCUMENTS

| | | | | |
|---|---|---|---|---|
| 5,339,548 A * | 8/1994 | Russell | A47G 19/2227 | 362/101 |
| 5,990,790 A * | 11/1999 | Lusareta | A47G 23/0306 | 206/459.1 |
| 6,140,932 A * | 10/2000 | Frank | A47G 19/2227 | 206/217 |
| 6,443,589 B1 * | 9/2002 | Lee | A47G 19/2227 | 362/101 |

(Continued)

FOREIGN PATENT DOCUMENTS

| | | |
|---|---|---|
| CN | 202504518 U | 10/2012 |
| CN | 203506280 U | 4/2014 |

*Primary Examiner* — Chun Cheung

(74) *Attorney, Agent, or Firm* — Oblon, McClelland, Maier & Neustadt, L.L.P.

(57) ABSTRACT

A cup that harnesses the positive psychological effects of cartoon to encourage and motivate a user to consume a beverage served in the cup. The cup has a beverage container and a sound-emitting base that is attached to the bottom of the container. The cup contains a capacitive liquid sensing system: two electrodes forming a capacitor that are flush mounted in the bottom of the beverage container, two spring loaded connectors that bridge between the electrodes and a capacitive liquid sensor that is contained in the base. The base further includes a power source, a processing unit, a memory module, an audio circuitry and an audio output device. When the beverage container is filled with a beverage, a resultant capacitance change activates playback of audio files saved in the memory module, which contains pre-recordings of cartoon voice.

16 Claims, 8 Drawing Sheets

(56) References Cited

U.S. PATENT DOCUMENTS

| | | | | |
|---|---|---|---|---|
| 8,550,288 | B2 * | 10/2013 | Briar | B65D 25/02 137/386 |
| 2001/0041945 | A1 * | 11/2001 | Lo | A47G 19/2227 700/94 |
| 2006/0261233 | A1 * | 11/2006 | Williams | A47G 19/2227 248/311.2 |
| 2012/0152782 | A1 | 6/2012 | Owens | |

* cited by examiner

SOUND-EMITTING CUP

CROSS-REFERENCE TO RELATED APPLICATIONS

This application claims the benefit of U.S. Provisional Application No. 62/212,750 filed Sep. 1, 2015.

BACKGROUND

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Food and nutrition are at the core of a child's growth and development. Indeed, healthy eating and healthy drinking contribute to overall healthy growth and development in children, which includes, for example, healthy bones, skin, energy levels and cognitive development. Healthy eating and drinking also contributes to a lowered risk of, for example, dental caries, eating disorders, constipation, malnutrition, and iron deficiency anemia.

It can be extremely stressful for parents when a child refuses to ingest essential or nutritional fluids such as water, milk and medicine. A child tends to be even less cooperative when he or she is tired, not feeling well, being shouted at, being pressured, being rushed, etc.

BRIEF SUMMARY OF THE INVENTION

According to a first aspect, the present disclosure relates to a cup. The cup includes a beverage container that has a main body extending distally to form a flange and a rim at a distal end, the flange having an inner wall, a bottom having a non-conductive material and being at an elevated position from the flange and the rim, a recessed portion disposed underneath the bottom and bounded by the bottom and the inner wall, two conductive plates mounted in the bottom, the two conductive plates being dielectrically insulated by the non-conductive material at a predetermined distance to form a capacitor, and a sound-emitting base configured to attach to the beverage container, the sound-emitting base having a digital audio playback system. The digital audio playback system has a capacitive liquid sensor electrically connected to two spring loaded connectors and configured to receive a first capacitance change from the capacitor when the beverage container is filled with a beverage, and processing circuitry configured to determine that the empty beverage container is filled with a beverage based on the first capacitance change and to activate playback of one or more pre-recorded digital audio files based on the determining.

In certain embodiments, the sound-emitting base further includes a projection having an outer surface and the two spring loaded connectors embedded in the projection, the projection being inserted in the recessed portion such that the two spring loaded connectors contact the conductive plates, and a housing disposed underneath the projection, the housing being configured to hold the digital audio playback system.

In some embodiments, the digital audio playback system further includes a memory module configured to store the one or more pre-recorded digital audio files.

In one embodiment, the non-conductive material includes one or more types of thermoplastic.

In at least one embodiment, the two conductive plates have one or more materials selected from the group consisting of elemental metals, alloys, semimetals and intrinsically conductive polymers.

In one or more embodiments, the two conductive plates are stainless steel.

In some embodiments, the inner wall and the outer surface are configured to interlock with each other to attach the sound-emitting base to the beverage container.

In one embodiment, the one or more pre-recorded digital audio files include cartoon voice(s).

In certain embodiments, the capacitive liquid sensor is further configured to detect and measure a second capacitance change when the beverage container is at least partially filled then becomes empty, and the processing circuitry is further configured to determine that the beverage filled-beverage container is empty based on the second capacitance change and to deactivate playback of the one or more pre-recorded digital audio files.

According to a second aspect, the present disclosure provides a cup having the a picture- and sound-emitting base. Further to the audio circuitry and the audio output device, the digital audio and video playback system of the picture- and sound-emitting base includes a video circuitry and a video output device.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
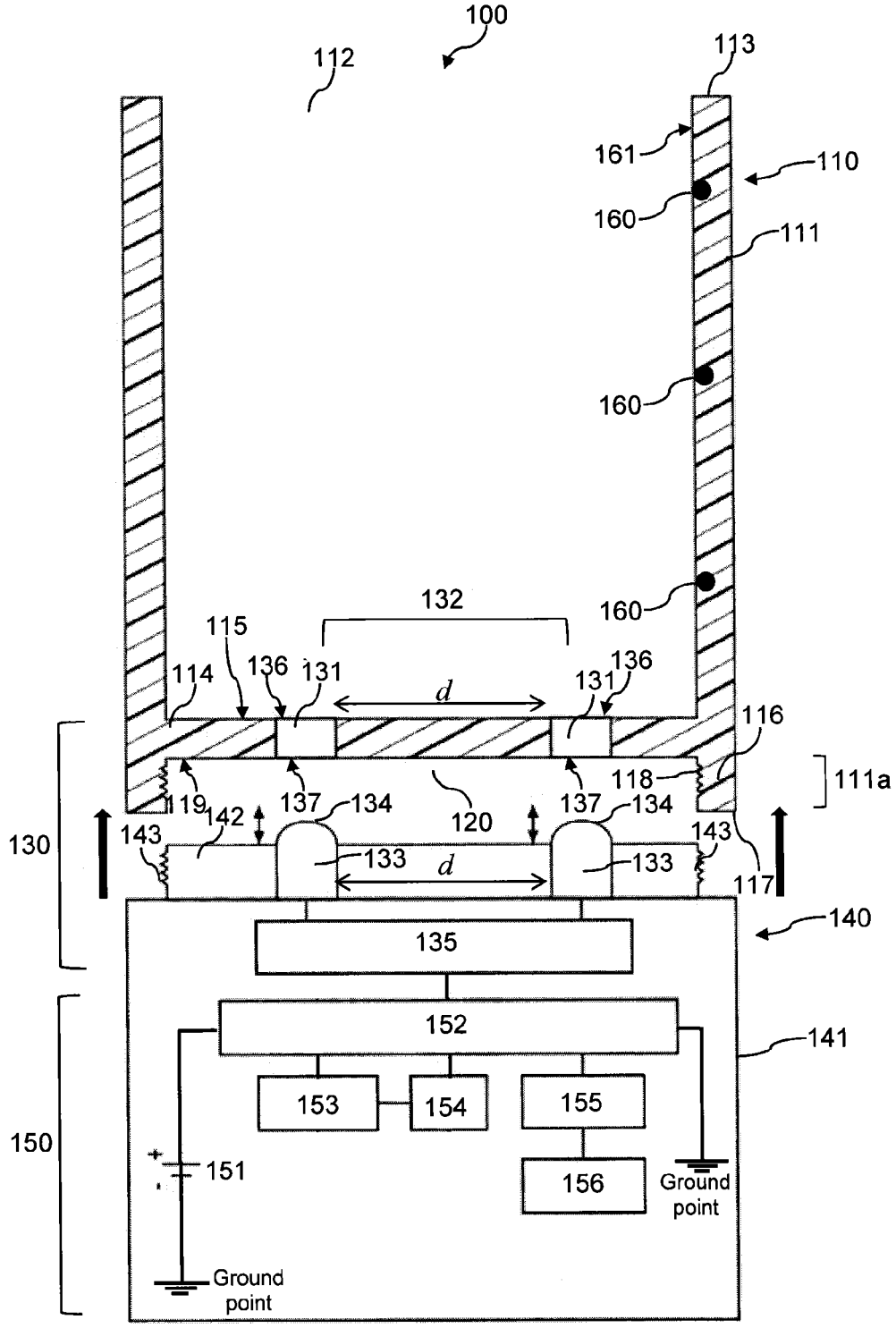
FIG. 1 is an exploded cross-sectional view of a cup having a liquid detection system and a digital audio playback system according to one embodiment.

Referring now to the FIGS. 1-4, wherein like reference numerals designate identical or corresponding parts throughout the several views. Reference through the specification to "one embodiment", "an embodiment", "an alternative embodiment", "certain embodiments", "other embodiments", "one or more embodiments", "at least one embodiment" means that a particular feature, structure, or characteristic described in connection with an embodiment is included in at least one embodiment of the subject matter disclosed. Thus, the appearance of the phrases "in one embodiment", "in an embodiment", "in an alternative embodiment", "in certain embodiments", "in other embodiments", "in at least one embodiment" and "in one or more embodiments" in various places throughout the specification is not necessarily referring to the same embodiment. Further, the particular features, structures or characteristics may be combined in any suitable manner in one or more embodiments. Additionally, it must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Further, terms such as "first", and "second" are used to describe to various elements and features, such as capacitance values and capacitance changes, only for purposes of clarity and discriminating one element or feature from another element or feature. These terms are not intended as limiting the elements and features to a particular order of their occurrence. Therefore, the elements and features are not limited to these terms.

The present disclosure provides a drinking utensil that alleviates a parent's stress when a child refuses to ingest a beverage. The drinking utensil utilizes positive psychology, in the form a child's favorite cartoon characters, to motivate and encourage the child to drink, and to turn the entire drinking experience into a more enjoyable and comforting one.

In FIG. 1, an exploded, front cross-sectional of a children's cup in accordance with one embodiment of the present disclosure is shown. Cup 100 is an assembly that includes a beverage container 110 and a sound-emitting base 140 that is configured to releasably or removably attach to the beverage container. Components of a digital audio playback system 150 in the sound-emitting base 140 are represented in block format in FIG. 1 and are further described with regard to FIG. 6. The present disclosure is not limited by any dimension and size of the beverage container 110 and the sound-emitting base 140.

The beverage container 110, which is adapted to hold and carry a beverage, includes a main body 111, an open proximal end 112 as defined by proximal rim 113, and a solid bottom 114. Through the open proximal end 112, a beverage can be poured into or consumed from the container. The solid bottom 114 has a top, flat surface 115 that defines the depth of the container 110 and the maximum volume of a beverage the beverage container 110 can hold. As with most cups and mugs, the proximal rim 113 and the solid bottom 114 are round but are not so limited. Accordingly, the main body 111 is cylindrical but is also not so limited. In one embodiment, the main body 111 is tapered from a larger area or diameter to a substantially reduced area or diameter, from the open top to the bottom, or vice versa, like a frustum cone. In an alternative embodiment, such as the one shown in FIG. 1, the main body 111 is straight and non-tapered.

Referring to FIG. 1, the main body 111 extends downwardly or distally to form, at distal end 111*a*, flange 116 and distal rim 117. The flange 116 further includes an inner wall 118 that may be threaded in select embodiments. The distal rim 117 is round in at least one embodiment. When laid on a surface such as a table surface or a kitchen countertop surface with the sound-emitting base 140 being attached thereto, the beverage container 110 rests upon the distal rim 117, with the solid bottom 114 being at an elevated position above the flange 116 and distal rim 117 such that bottom surface 119 is not in contact with the surface. Due to the elevation, a recessed portion 120 is disposed underneath the solid bottom 114 and is bounded by the bottom surface 119 and the inner wall 118. The recessed portion is configured to receive the sound-emitting base during assembly of the cup.

At least the solid bottom 114 or the entirety of the beverage container 110 is made of one or more non-conductive materials such as thermoplastics, glass and ceramic. Thermoplastics, which are non-fragile, can be used when the cup provided herein is intended for a child. Examples of suitable thermoplastic include but are not limited to polypropylene, low density polyethylene, medium density polyethylene, high density polyethylene, polyethylene terephthalate, copolymers and mixtures thereof.

In certain embodiments, the main body 111 is advantageously graduated so that the volume of a beverage to be offered to a user can be measured. This is especially important when a medicine at a specific dosage is given to a child. Additionally, measuring fluids and beverages are desirable when monitoring a child's diet and ensuring that the child is sufficiently hydrated.

In some embodiments, the beverage container 110 further includes one or more handles attached to the main body 111 (not shown in FIG. 1).

Figure 2A:
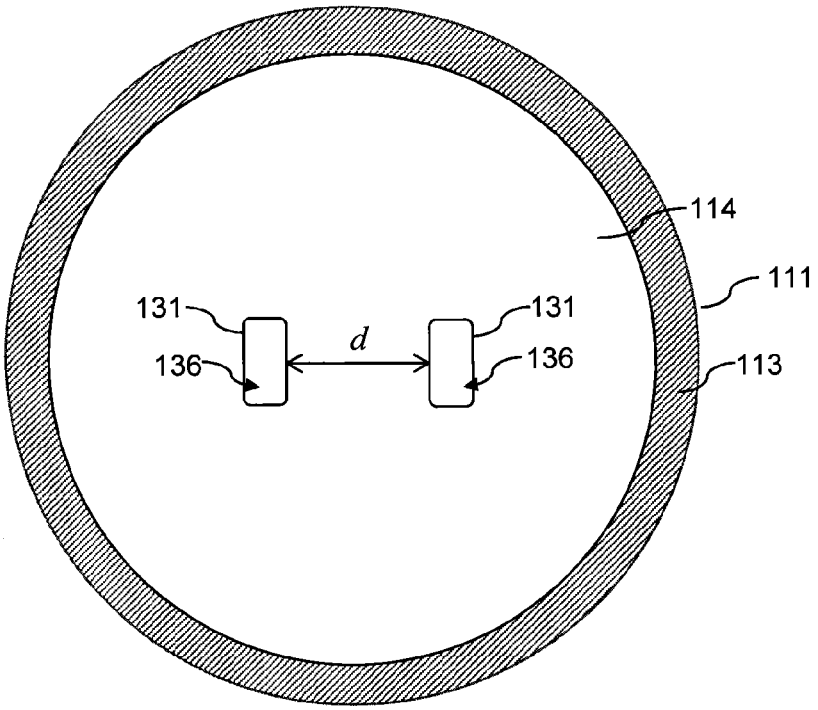
FIG. 2A is a top view of the beverage container component of a children's cup according to one embodiment, where two metal plates are flush mounted in the cup bottom and the main body of the beverage container is non-tapered.
Figure 2B:
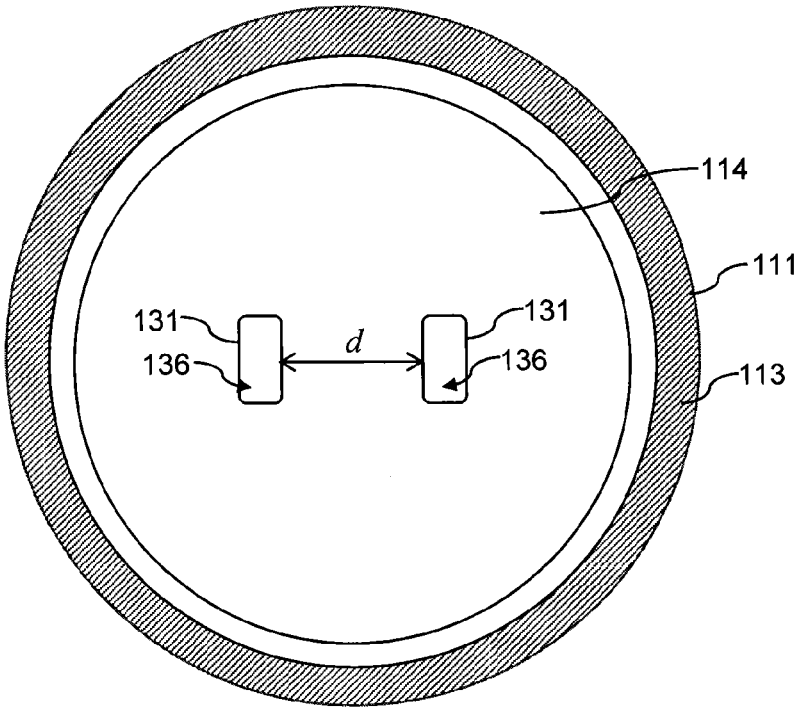
FIG. 2B is a top view of the beverage container of a cup according to one embodiment, where two metal plates are flush mounted in the cup bottom and the main body of the beverage container is tapered from the open top to the bottom.

As shown in FIGS. 1, 2A and 2B, the beverage container 110 contains one or more conductive plates or chips 131 (two illustrated in FIGS. 1, 2A and 2B) that are flush mounted to the solid bottom 114 such that top surface 136 and bottom surface 137 of the plates 131 are exposed and the two plates 131 are parallel to each other. These two conductive plates 131, which can be of any geometry/shape and are electrically insulated from each other by the non-conductive dielectric material of the solid bottom 114 at a predetermined distance d, act as two electrodes that form a capacitor 132 that is part of a capacitive liquid sensing system 130. The conductive plates are made of a metallic material (elemental metal, alloy or a combination thereof) that is non-toxic and corrosion-resistant. In one embodiment, the conductive plates are made of stainless steel. Alternatively, the conductive plates are made of other non-metallic conductive materials such as semimetals (e.g. antimony, selenium) and intrinsically conducting polymers (e.g. polyanilines, polypyrroles, poly(3,4-ethylenedioxythiophene)). In some embodiments, the conductive plates are made of a combination of metallic and non-metallic conductive materials.

The capacitive liquid sensing system 130, as seen in FIG. 1, includes: capacitor 132 comprising two conductive plates 131 that are dielectrically insulated from each other in the beverage container, at least one spring loaded connector 133 and a capacitive liquid sensor 135 in the sound-emitting base.

Still referring to FIG. 1, the sound-emitting base 140 includes a housing 141 that is adapted to contain a plurality of electronic components, and a projection 142 that is disposed on top of the housing 141. In one embodiment, both the housing 141 and the projection 142 are generally cylindrical in shape with the projection being a smaller cylinder, as seen in FIG. 1.

The projection 142 has an outer surface 143 which, in select embodiments, has a threaded finish. The projection 142 is configured to be inserted into the recessed portion 120. The outer surface 143 and the inner wall 118 are configured to interlock with each other by twisting the sound-emitting base 140 in a predetermined rotation direction (usually counter-clockwise) so that the sound-emitting base 140 can be firmly attached to the beverage container 110 when the cup 100 is in use. Accordingly, both can the sound-emitting base 140 and the beverage container 110 can be threaded to create an interlocking mechanism. Other interlocking mechanisms such as the snap-fit mechanism may also be acceptable. The sound-emitting base 140 can be easily detached from the beverage container 110, for example, for washing of the container or switching to a different sound-emitting base, by twisting the sound-emitting base in the opposing rotation direction.

Figure 3:
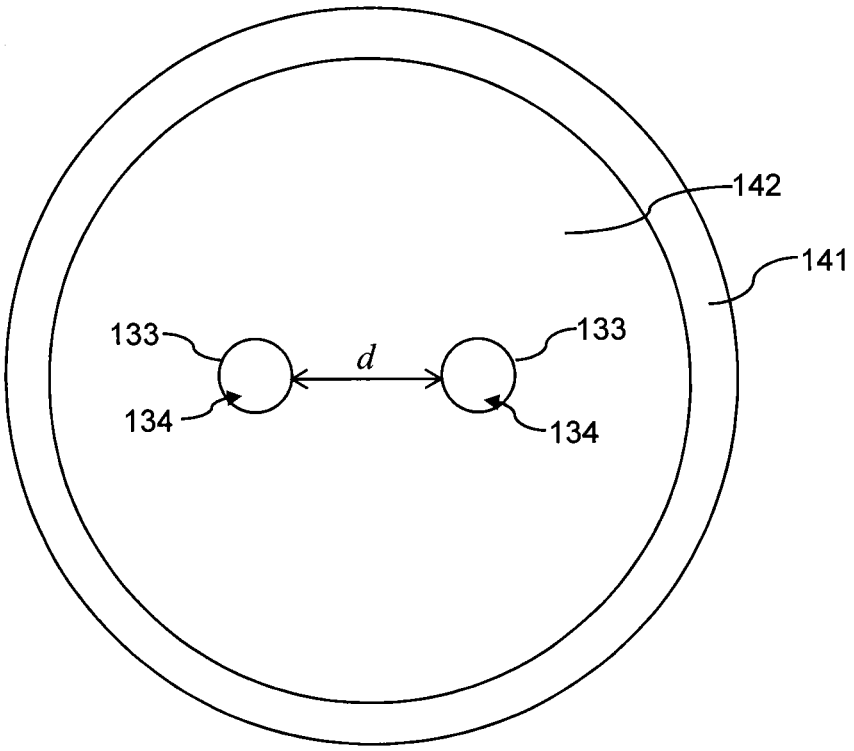
FIG. 3 is a top view of the sound-emitting base of a cup according to one embodiment, showing the top projection and two spring loaded connectors embedded in the projection.

Referring to FIGS. 1 and 3, two spring loaded connectors 133 are embedded in the projection 142 and, like the aforementioned capacitor electrodes, are also separated by the predetermined distance, d. Each connector has a proximal tip 134 that is configured to retract when it is contacted with and pressed against the bottom surface 137 when the beverage container 110 and the sound-emitting base 140 are assembled to form the cup 100. In FIG. 1, the proximal tips 134 are shown as rounded but spring loaded connectors having flat tips are also acceptable.

The spring loaded connectors 133 are electrically connected to the capacitive liquid sensor 135 in the housing 141. The capacitive liquid sensor 135 interfaces directly with the digital audio playback system 150 through a communication and power bus 152. Accordingly, capacitance generated by the capacitor 132 in the absence or presence of a beverage filling the beverage container 110 is detected and measured by the capacitive liquid sensor 135 via the spring loaded connectors 133. Based on the capacitance that is detected and measured, the capacitive liquid sensor 135 generates a signal that is received by a central processing unit (CPU) 153 for further processing as detailed below.

The digital audio playback system 150, as shown in FIG. 1, includes: the communication and power bus 152 that is configured to link the capacitive liquid sensor 135 to the digital audio playback system 150, link components and peripherals of the digital audio playback system 150 to transfer data, signals and electric power; one or more batteries 151 (optionally rechargeable) that are configured to provide electric power to the capacitive liquid sensor 135 and the digital audio playback system 150 through the communication and power bus 152; the central processing unit (CPU) 153 that is configured to process input data/signals from the capacitive liquid sensor 135 and execute instructions of a plurality of computer software programs via basic arithmetic, logical, control and input/output operations specified by the instructions; a memory module 154 coupled to and in continuous electronic communication with the CPU 153 that is configured to store the CPU processing data, the computer program instructions and digital audio files containing pre-recordings of a child's favorite voices or sounds; audio circuitry 155 that is configured to receive commands or instructions from the CPU 153 to playback one or more pre-recorded digital audio files and generate an analog audio signal, then amplify the analog audio signal; and an audio output device 156 (e.g. a loudspeaker) that converts the analog audio signal into sound.

In certain embodiments, the memory module 154 is further configured to store two data libraries: a database of capacitance values that correlate with different beverage categories and a database of digital audio files containing messages pre-recorded with one or more sounds that each relate to a specific beverage category and are so categorized. Common beverages can be divided into multiple categories based on the chemical composition of their background matrices which would influence their ability to conduct electricity between the two electrodes of the capacitor 132, resulting in different capacitances that are detected and measured by the capacitive liquid sensor 135: water (clear background matrix); creamy beverages like milk, yogurt (background matrix has a high protein content and possibly fat content); juices (acidic background matrix); soups (background matrix has a high salt content); medicine (viscous and background matrix has a high sugar content and a high aromatics content). Accordingly, the CPU 153 is further configured to compare a measured capacitance with the database, identify a beverage category, select one or more digital audio files from the digital audio file database that are relevant to the identified beverage category and activate the playback thereof.

The pre-recorded digital audio files may be in compressed or uncompressed formats, with examples including but not limited to Opus, MP3, Vorbis, Musepack, AAC, ATRAC, WMA Lossy, MPEG-4 SLS, MPEG-4 ALS, MPEG-4 DSC, WMA Lossless, Shorten, ALAC, ATRAC Advanced Lossless, TTA, WavPack, FLAC, Monkey's Audio, WAV, AIFF, AU and raw header-less PCM.

The CPU 153 may be a Xenon or Core processor from Intel of America or an Opteron processor from AMD of America, or may be other processor types that would be recognized by a person of ordinary skill in the art. Alternatively, the CPU 153 may be implemented on an FPGA, ASIC, PLD or using discrete logic circuits, as one of ordinary skill in the art would recognize. Further, the CPU 153 may be implemented as multiple processors cooperatively working in parallel to perform the instructions of processes 400, 500, 700 and 800 that are described below.

The memory module 154 includes at least one portable non-transitory computer readable storage medium where the CPU processing data, instructions and pre-recorded digital audio files may be stored permanently or temporarily. Examples of such portable non-transitory computer readable storage media include but are not limited to hard disk drive (HDD), RAM, ROM, PROM, EPROM, EEPROM and FLASH.

Figure 4:
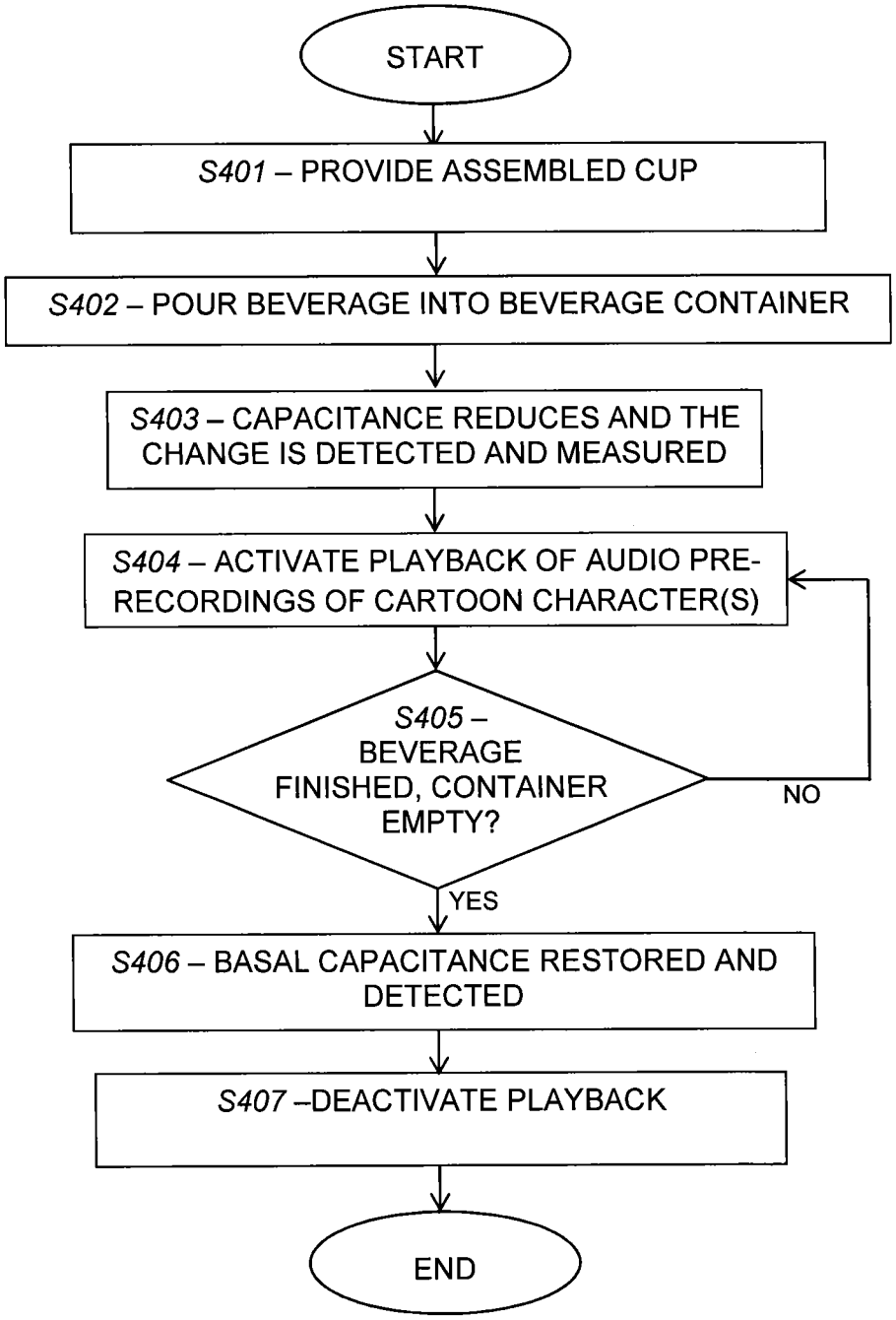
FIG. 4 is a flowchart illustrating a process of activating audio recording playback of the cup by detection and measurement of capacitance change according to one embodiment.

FIG. 4 is a flowchart illustrating a process of activating audio recording playback of the cup by detection and measurement of capacitance change according to one embodiment. The process 400 begins at step S401 where an assembled cup 100 having the beverage container 110 and the sound-emitting base 140 is provided. Throughout the process 400, the bottom surfaces 137 of the two parallel and dielectrically insulated conductive plates 131 abut against the retracted proximal tips 134 of the two spring loaded connectors 133, which are in turn electrically connected to the capacitive liquid sensor 135.

At step S401, the capacitor 132 has a predetermined initial capacitance which is detected by the capacitive liquid sensor 135. As used herein, "capacitance" refers to the electrical chargeability or the ability to store electrical charge of the capacitor. The capacitive liquid sensor 135 converts the initial capacitance to a corresponding output initial voltage signal that is received by the CPU 153, which is pre-programmed with the initial capacitance and to interpret the initial capacitance as the beverage container 110 not carrying any fluid.

At step S402, a beverage which may be water, milk, fruit juice or medicine for example is poured into the beverage container 110 and the cup 100 is handed to a child. Consequently, at step 403, the beverage contacts the conductive plates 131, and serves as a conducting medium and an electric voltage becomes present between the two conductive plates, thereby creating an electric field. At the same time, as the capacitor 132 is no longer insulated and electrons stored inside the capacitor are now conducted by the beverage, the capacitance drops from the initial capacitance value. The resultant capacitance is detected and measured by the capacitive liquid sensor 135 which converts the resultant capacitance to a corresponding output voltage signal that is received and interpreted by the CPU 153 as a beverage being present in the beverage container 110.

Next, at step S404, the CPU 153 is configured to activate playback of the one or more pre-recorded digital audio files (stored in the memory module 154) by the audio circuitry 155, by comparing capacitance values stored in the memory module 154. The digital audio files contain pre-recordings of a child's favorite audio voices and sounds, such as cartoon voices reciting generic words and phrases of encouragement.

The process 400 proceeds to step S405 where the CPU 153 determines if the beverage is finished and the beverage container 110 is empty. The CPU 153 is pre-programmed with to determine that the beverage container 110 is empty at step S406, based on restoration of the initial capacitance, or within a predetermined plus/minus range, which is detected by the capacitive liquid sensor 135 for a predetermined time period (e.g. 30 seconds or 1 min) and communicated to the CPU 153 as the corresponding initial voltage signal for the same predetermined prolonged time period. After the beverage container 110 has been determined to be empty at step S406, the CPU deactivates the pre-recorded digital audio file playback at step S407 and the process 400 may conclude with a generic laudatory remark such as "Well done", "Good job", etc.

If, at step S405, the initial capacitance is not detected for the predetermined time period, the pre-recorded digital audio file playback continues without any interruption.

Figure 5:
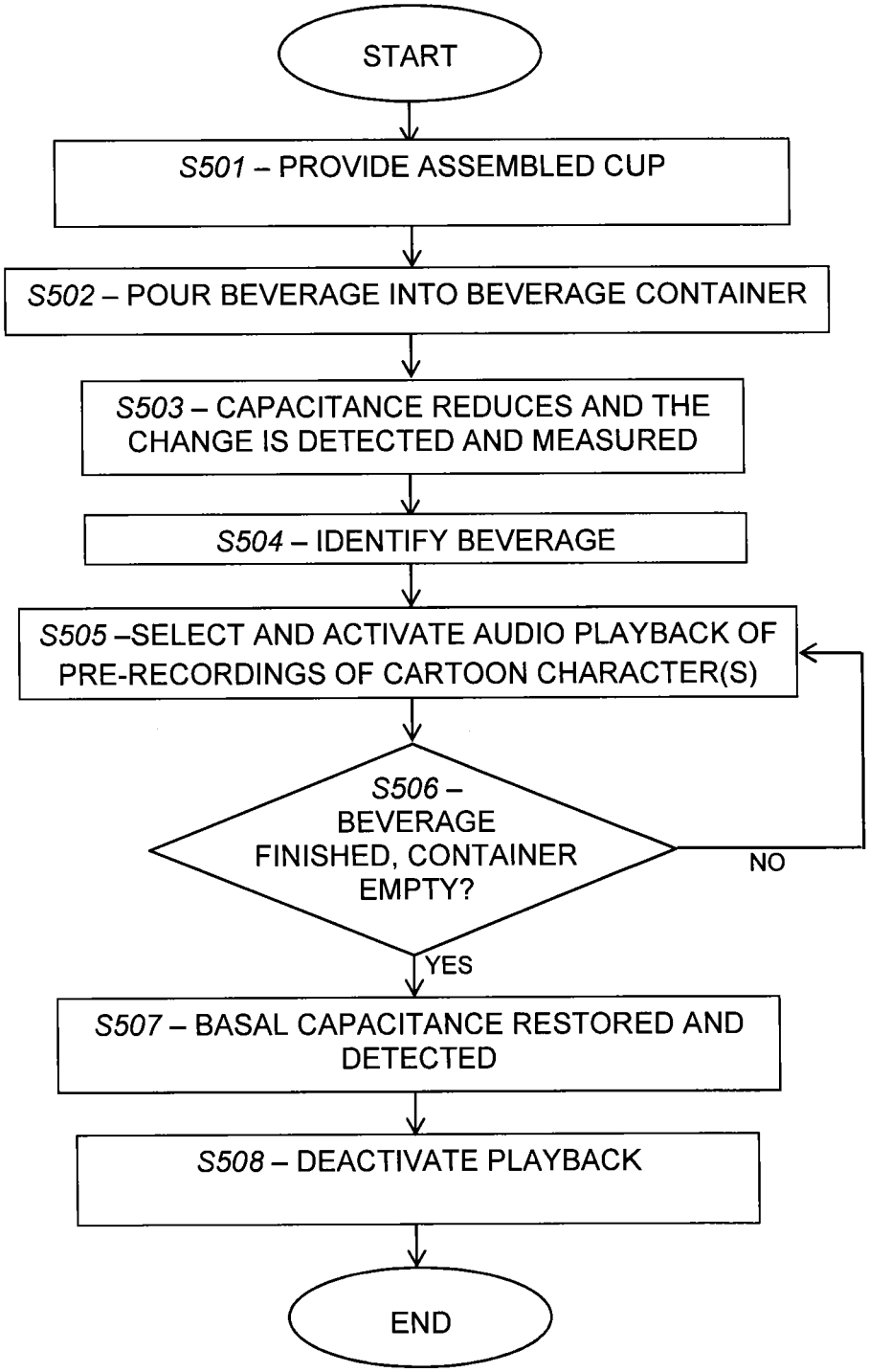
FIG. 5 is a flowchart illustrating a process of selecting and activating audio recording playback of the cup by detection and measurement of capacitance change then identification of a beverage category according to one embodiment.

Relative to the process 400, the process 500 as shown in FIG. 5 further includes the functions of identifying a beverage category and selecting the pertinent digital audio files from a digital audio file database stored in the memory module 154 that are specific towards the identified beverage category. Steps S501-S503 are same as steps S401-S403 where a cup 100 having the initial capacitance is provided then a beverage is poured into the beverage container 110 causing a change in capacitance, which is detected and measured by the capacitive liquid sensor 135. The CPU 153 is pre-programmed to interpret the capacitance change as a beverage being present in the beverage container 110. At step S504, the CPU 153 is further configured to compare the detected capacitance change to a database of measured and known capacitances for the variety of beverage categories described herein and identify the category of the beverage.

Subsequently, at step S505, the CPU 153 is configured to select and activate playback of one or more pre-recorded digital audio files that are specific towards the identified beverage category from the digital audio file database stored in the memory module 154. In addition to words and phrases of encouragement, these pre-recordings contain a child's cartoon voice(s) reciting category-specific educational messages, for example, messages that explain to a user the importance of drinking sufficient water to stay hydrated, nutritional benefits of milk or how a medicine helps him or her feel better.

Similar to the process 400, the process 400 proceeds to step S506 where the CPU 153 determines if the beverage is finished and the beverage container 110 is empty, based on restoration of the initial capacitance detected by the capacitive liquid sensor 135 for the predetermined time period. After the beverage container 110 has been determined to be empty at step S507, the CPU 153 deactivates the pre-recorded digital audio file playback at step S508 and the process 500 may conclude with a category-specific remark such as "Get well soon" when the beverage is identified as medicine or "Your teeth and bones are now much stronger and healthier" when the beverage is milk.

Figure 6:
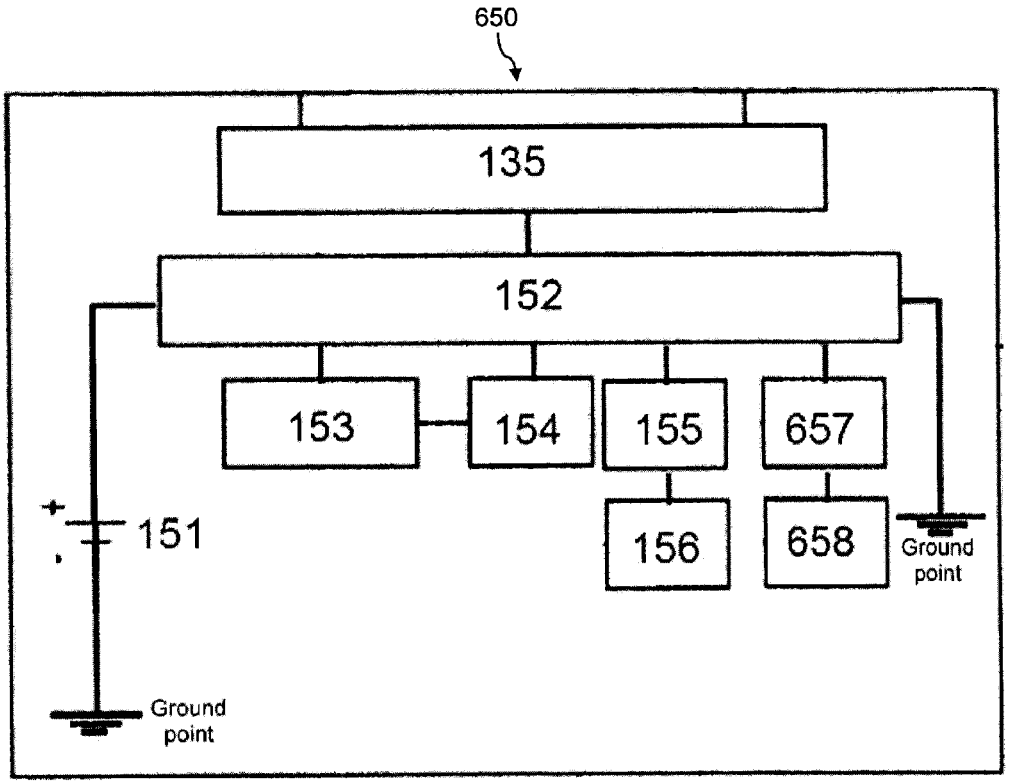
FIG. 6 is a block diagram of a digital audio and video playback system according to one embodiment.
Figure 7:
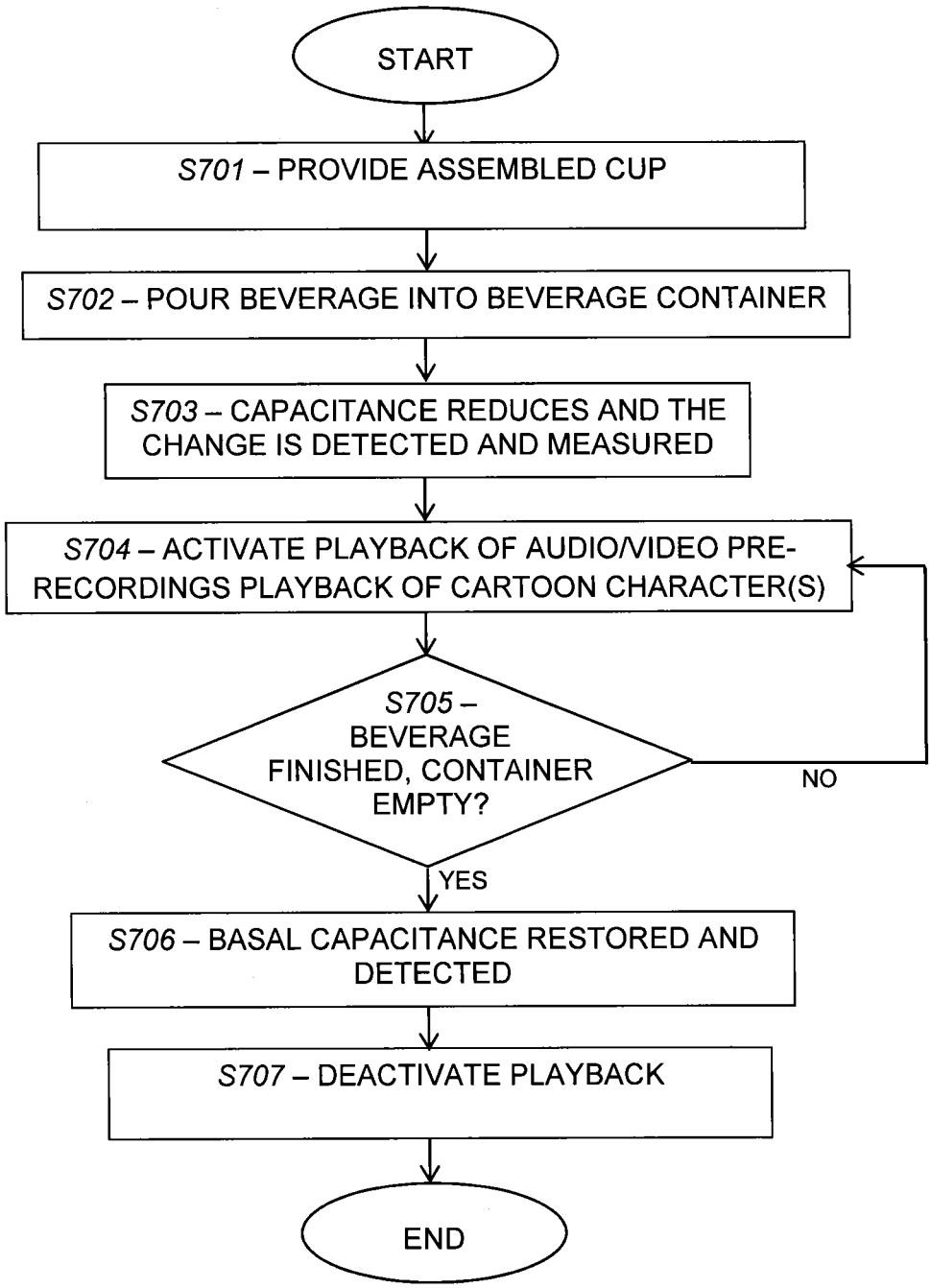
FIG. 7 is a flowchart illustrating a process of activating audio and video recording playback of the cup by detection and measurement of capacitance change according to one embodiment.
Figure 8:
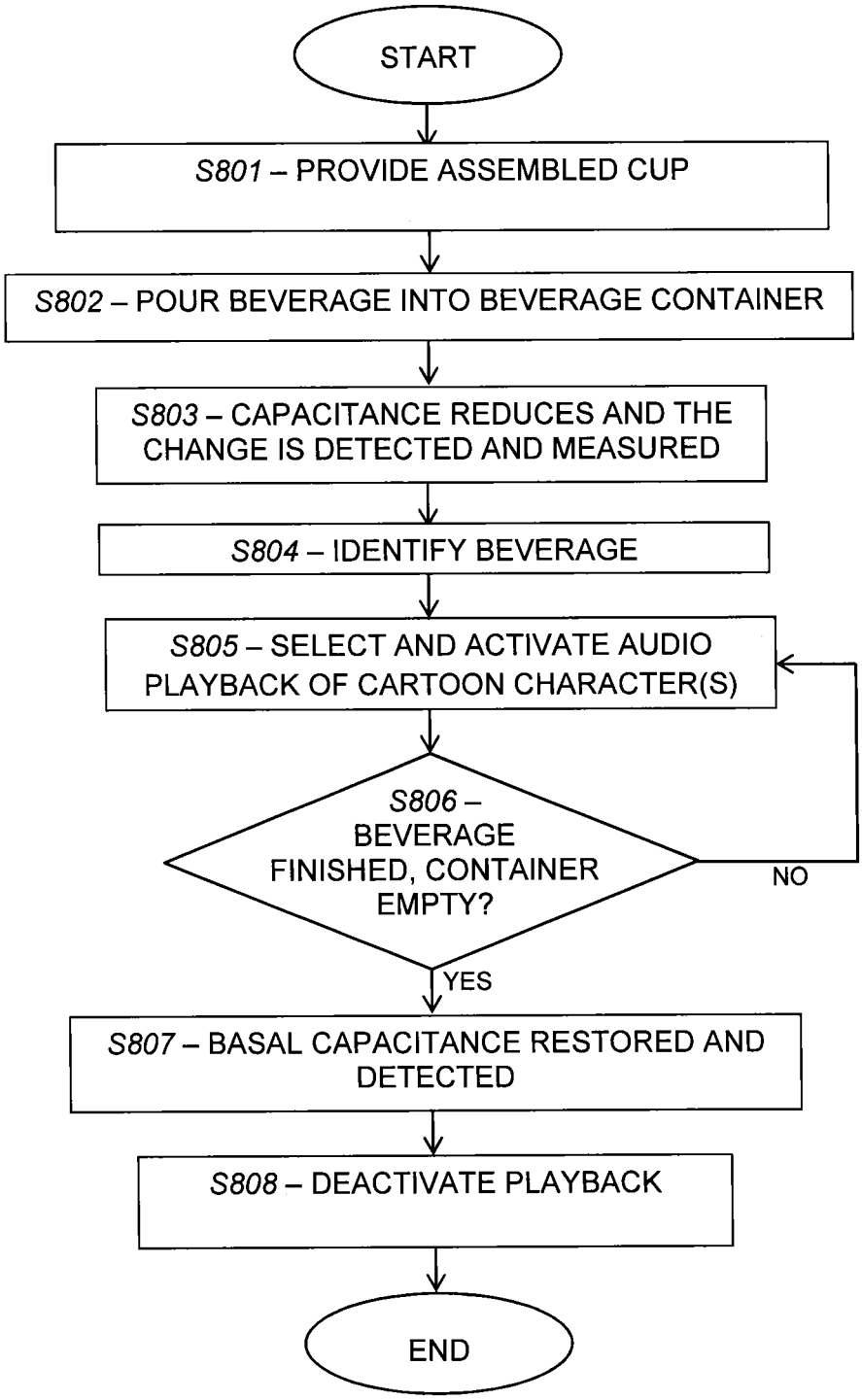
FIG. 8 is a flowchart illustrating a process of selecting and detecting audio and video playback of the cup by detection and measurement of capacitance change then identification of a beverage category according to one embodiment.

Embodiments of the present disclosure further include a cup having a picture and sound-emitting, detachable base. FIG. 6 shows components of a digital audio and video playback system 650 of a picture and sound-emitting base according to one embodiment. Besides the capacitive liquid sensor 135, the one or more battery cells 151, the communication and power bus 152, the CPU 153, the memory module 154, the audio circuitry 155 and the audio output device 156 as described herein, the digital audio and video playback system 650 includes: video circuitry 657 that is configured to receive commands from the CPU 153 to playback one or more pre-recorded digital video files and generate an analog audio signal and an analog video signal, then amplify the analog video signal; and a video output device 658 (e.g. a liquid crystal display screen) that converts the analog video signal into picture. The picture may be one or more still images or animations of a cartoon character. To detect capacitance, the capacitive liquid sensor 135 is electrically connected with the two spring loaded connectors 133 and the connectors are in contact and pressed against the two conductive plates or electrodes 131 of the capacitor 132.

Accordingly, processes for activating audio and video recording playback of the cup by detection and measurement of a capacitance change that is induced by a beverage, and optionally identifying category of the beverage, are provided in the present disclosure. In the process 700, a cup having a beverage container 110, a picture and sound-emitting base and initial capacitance is provided at step S701. A beverage is poured into the beverage container 110 and the cup containing the beverage is offered to a user to be drunk at step S702. At step S703, due to the presence of the beverage as a conducting medium, the capacitance changes, and this is detected and measured by the capacitive liquid sensor 135. The capacitive liquid sensor 135 sends a corresponding signal to the CPU 153 which then, at step S704, activates the audio circuitry 155 and the video circuitry 657 to playback one or more digital audio files and one or more digital video files that are stored in the memory module 154. At step S705, the CPU 153 determines if the beverage is finished and the beverage container 110 is empty, based on restoration of the initial capacitance detected by the capacitive liquid sensor 135 for the predetermined time period. Next, at step S706 the beverage container 110 is determined by the CPU 153 to be empty, and at step S707 the CPU deactivates the pre-recorded digital audio file and video file playback.

In the process 800, steps S801-S803 are same as steps S701-S703 where a cup having a beverage container 110, a picture and sound-emitting base and initial capacitance is provided then a beverage is poured into the beverage container 110, resulting in a change in capacitance that is detected and measured by the capacitive liquid sensor 135. At step S804, further to interpreting the capacitance change as the presence of a beverage in the beverage container 110, the CPU 153 is configured to compare the detected capacitance to the beverage category-based capacitance database stored in the memory module 154 and identify the category of the beverage. At step S805, the CPU 153 is configured to select and activate to playback one or more digital audio files and one or more digital video files that are stored in the memory module 154 that are specific towards the identified beverage category, as described for step S505 for the process 500. The process 800 proceeds to step S806 where the CPU 153 determines if the beverage is finished and the beverage container 110 is empty as previously described herein. At step S807, the CPU 153 determines that the beverage container 110 is empty and at step S808, the CPU 153 deactivates the pre-recorded digital audio file and video file playback.

In the processes 400, 500, 700 and 800, the cup 100 can be configured, through pre-programming of the CPU 153, to emit sound(s) when it is time for a child to take medicine. In a similar manner, in the processes 500 and 800, the cup 100 can be further configured to emit picture.

In some embodiments, the main body 111 of the beverage container 110 includes a plurality of liquid level sensors 160 that are flush mounted at inner wall 161 and are separated apart at predetermined distances along the inner wall 161, as indicated in FIG. 1. Upon contact with a fluid, such as a beverage in the beverage container 110, each liquid level sensor is activated and is configured to send a signal via a wireless network to the CPU 153. Examples of a wireless network include but are not limited to WLAN, WPAN, WMAN and WWAN. Therefore, as a beverage contained in the beverage container 110 is being consumed by a user and the beverage level decreases, the number of liquid level sensors 160 that is being activated and the amount of signals received by the CPU 153 also changes accordingly. Based on each change in the amount of signals received, the CPU 153 is configured to activate playback of different pre-recorded digital audio files and further, in select embodiments, different pre-recorded digital video files. In at least one embodiment, the plurality of liquid level sensors can be used to determine if a user has finished consuming all of a beverage contained in the beverage container 110, such as but not limited to medicine and if not, a signal is sent to the CPU 153 which activates playback of a pre-recorded warning sound that is stored in the memory module 154.

In an alternative embodiment, the main body 111 of the beverage container 110 includes one or more motion sensors (not shown in FIG. 1) that are configured to detect movement (e.g. when the cup 100 is lifted by a user to ingest a beverage) and to send a signal, preferably via a wireless network as defined herein, to the CPU 153. The CPU 153 then activates the playback of the pre-recorded digital audio files. After the user finishes consuming the beverage and the beverage container 110 becomes empty, the capacitance change is detected by the capacitive liquid sensor 135 and a signal is sent from the capacitive liquid sensor 135 to the CPU 153 to activate the playback of the pre-recorded digital video files Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A cup, comprising:

a beverage container having:

a main body extending distally to form a flange and a rim at a distal end, the flange having an inner wall, a bottom having a non-conductive material and being at an elevated position from the flange and the rim, a recessed portion disposed underneath the bottom and bounded by the bottom and the inner wall, two conductive plates mounted in the bottom, the two conductive plates being dielectrically insulated by the non-conductive material at a predetermined distance to form a capacitor, and a sound-emitting base configured to attach to the beverage container, the sound-emitting base having a digital audio playback system, the digital audio playback system having:

a capacitive liquid sensor electrically connected to two spring loaded connectors and configured to receive a first capacitance change from the capacitor when the beverage container is filled with a beverage, a memory module configured to store one or more pre-recorded digital audio files and a database having a plurality of capacitance values that correlate with a plurality of beverage categories, and processing circuitry configured to compare the first capacitance change to the database to identify a beverage category, and to select one or more pre-recorded digital audio files based on the beverage category, determine that the empty beverage container is filled with a beverage based on the first capacitance change and to activate playback of the selected one or more pre-recorded digital audio files based on the determining.

2. The cup of claim 1, wherein the sound-emitting base further includes:

a projection having an outer surface and the two spring loaded connectors embedded in the projection, the projection being inserted in the recessed portion such that the two spring loaded connectors contact the conductive plates, and a housing disposed underneath the projection, the housing being configured to hold the digital audio playback system.

3. The cup of claim 1, wherein the non-conductive material includes one or more types of thermoplastic.

4. The cup of claim 1, wherein the two conductive plates have one or more materials selected from the group consisting of elemental metals, alloys, semimetals and intrinsically conductive polymers.

5. The cup of claim 1, wherein the two conductive plates are stainless steel.

6. The cup of claim 1, wherein the inner wall and the outer surface are configured to interlock with each other to attach the sound-emitting base to the beverage container.

7. The cup of claim 1, wherein the one or more pre-recorded digital audio files include cartoon voice(s).

8. The cup of claim 1, wherein:

the capacitive liquid sensor is further configured to detect and measure a second capacitance change when the beverage container is at least partially filled then becomes empty, and the processing circuitry is further configured to determine that the beverage filled-beverage container is empty based on the second capacitance change and to deactivate playback of the one or more pre-recorded digital audio files.

9. A cup, comprising:

a beverage container having:

a main body extending distally to form a flange and a rim at a distal end, the flange having an inner wall, a bottom having a non-conductive material and being at an elevated position from the flange and the rim, a recessed portion disposed underneath the bottom and bounded by the bottom and the inner wall, two conductive plates mounted in the bottom, the two conductive plates being dielectrically insulated by the non-conductive material at a predetermined distance to form a capacitor, and a picture- and sound-emitting base configured to attach to the beverage container, the picture- and sound-emitting base having a digital audio and video playback system, the digital audio and video playback system having:

a capacitive liquid sensor electrically connected to two spring loaded connectors and configured to receive a first capacitance change from the capacitor when the beverage container is filled with a beverage, a memory module configured to store one or more pre-recorded digital audio files and one or more pre-recorded digital video files, and a database having a plurality of capacitance values that correlate with a plurality of beverage categories, and processing circuitry configured to compare the first capacitance change to the database to identify a beverage category, and to select one or more pre-recorded digital audio files and one or more pre-recorded digital video files based on the beverage category, and determine that the empty beverage container is filled with a beverage based on the first capacitance change and to activate playback of the selected one or more pre-recorded digital audio files and the selected one or more pre-recorded digital video files based on the determining.

10. The cup of claim 9, wherein the sound-emitting base further includes:

a projection having an outer surface and the two spring loaded connectors embedded in the projection, the projection being inserted in the recessed portion such that the two spring loaded connectors contact the conductive plates, and a housing disposed underneath the projection, the housing being configured to hold the digital audio and video playback system.

11. The cup of claim 9, wherein the non-conductive material includes one or more types of thermoplastic.

12. The cup of claim 9, wherein the two conductive plates have one or more materials selected from the group consisting of elemental metals, alloys, semimetals and intrinsically conductive polymers.

13. The cup of claim 9, wherein the two conductive plates are stainless steel.

14. The cup of claim 9, wherein the inner wall and the outer surface are configured to interlock with each other to attach the picture- and sound-emitting base to the beverage container.

15. The cup of claim 9, wherein the one or more pre-recorded digital audio files include cartoon voice(s) and the one or more pre-recorded digital video files include one or more images of one or more cartoon characters, one or more cartoon animations, or both.

16. The cup of claim 9, wherein:

the capacitive liquid sensor is further configured to detect and measure a second capacitance change when the beverage container is at least partially filled then becomes empty, and the processing circuitry is further configured to determine that the beverage filled-beverage container is empty based on the second capacitance change and to deactivate playback of the one or more pre-recorded digital audio files.

* * * * *